United States Patent [19]

Haesters et al.

[11] 4,244,194

[45] Jan. 13, 1981

[54] EVAPORATOR, PARTICULARLY FOR AIR CONDITIONING DEVICES

[75] Inventors: Hermann Haesters, Pulheim; Erich Altdorf, Cologne; Siegfried Lorenz, Frechen-Hulchen; Bernd Forsting, Rheydt, all of Fed. Rep. of Germany

[73] Assignee: Ford Motor Company, Dearborn, Mich.

[21] Appl. No.: 70,089

[22] Filed: Aug. 27, 1979

[30] Foreign Application Priority Data

Feb. 11, 1978 [DE] Fed. Rep. of Germany ..... 2847525

[51] Int. Cl.[3] ..... F25B 39/02

[52] U.S. Cl. ..... 62/515; 165/173; 165/180

[58] Field of Search ..... 62/515; 165/173, 180

[56] References Cited

U.S. PATENT DOCUMENTS

| | | | |
|---|---|---|---|
| 1,589,646 | 6/1926 | Hicks | 165/173 |
| 3,710,858 | 1/1973 | Young | 165/173 |
| 3,993,126 | 11/1976 | Taylor | 165/173 |

FOREIGN PATENT DOCUMENTS

| | | | |
|---|---|---|---|
| 2135647 | 5/1972 | Fed. Rep. of Germany | 165/173 |
| 2709846 | 11/1977 | Fed. Rep. of Germany | 165/173 |

*Primary Examiner*—Ronald C. Capossela

*Attorney, Agent, or Firm*—Steven L. Permut; Clifford L. Sadler

[57] ABSTRACT

An evaporator is fabricated from metal pipes bundled together by cooling fins. The pipes have their ends embedded in a curable plastic securing them to a plastic collecting box. The collecting box has a distributing section with a plurality of injection orifices and return orifices flowing respectively into injection chambers and return flow chambers. The injection chambers merge into an injection collecting chamber and the return flow chambers merge into a return collecting chamber. A plastic connecting section has an integral injection pipe and return pipe and is connected to the distributor pipe by a tongue and groove connection sealably secured together by a curable plastic. The injection pipe and return flow pipe are in fluid communication with the injection collecting chamber and return collecting chamber respectively.

2 Claims, 9 Drawing Figures

EVAPORATOR, PARTICULARLY FOR AIR CONDITIONING DEVICES

BACKGROUND OF THE INVENTION

1. Field of the Invention

The invention relates to an evaporator, especially for air-conditioning installations.

2. Description of the Prior Art

A plurality of embodiments of evaporators, especially for air-conditioning installations, is known.

In one of these known constructions, the evaporator pipes, bent into several lengths running to and fro, are each bonded, by soldering, at their inlet end to a single small metallic injection pipe and at their outlet end to a metal return flow pipe.

The other ends of this plurality of individual metallic injection pipes and metallic return flow pipes are in turn soldered to corresponding metallic funnel-shaped collector parts, which form the connecting pipes for the injection valve or the compressor intake line.

These known evaporators are extremely expensive to manufacture because of the numerous different pipe dimensions, the numerous pipe shaping operations required and the equally numerous soldered pipe connections. Furthermore the soldered bonds, can only be produced manually which causes quality to vary as the expertise of different solderers vary.

Furthermore, the restriction to a limited number of injection pipes, necessitated by the high costs, and the coldness losses occurring at the long metallic pipe branches considerably detract from the effective cooling capacity of the known evaporators.

SUMMARY OF THE INVENTION

As a result of the use of a construction with metallic evaporator pipes and connecting boxes made of plastic, the manufacturing costs of such evaporators can be substantially reduced and their effective cooling capacity can be increased.

It is the object of the invention to construct an evaporator of the stated construction in such a way that its manufacturing costs are reduced yet further and its effective cooling capacity is improved substantially.

According to the invention, the connecting box includes a distributor part and a connecting part, which are sealed, and firmly bonded to one another via a tongue and groove bond by means of a curable plastic.

Further according to the invention, the distributor part includes several injection chambers and return flow chambers. Each injection chamber has a plurality of injection orifices connected thereto and each return flow chamber has a plurality of return flow orifices connected thereto. Each orifice is parallel to one another. The injection chambers in turn are in fluid connection with a first collecting chamber. The return flow chambers are in fluid communication with a second collecting chamber.

Preferably, the injection paths and return flow paths of the coolant are firstly kept to the desired minimum dimensions and secondly are run through an insulating plastic, so that the loss of coldness which is hardly avoidable in known evaporators is prevented and hence the effective cooling capacity of the evaporator is increased.

As a result of dispensing with any bond made by metal melting or soldering, it becomes possible for approximately the same manufacturing costs, to use aluminum evaporator pipes thereby achieving substantial weight savings which is particularly desirable for evaporators in motor vehicles and the like.

In one embodiment, the connecting pipes for the injection valve and the compressor intake line are integrally formed with the connecting part, and are formed with mold-on collars. The integral connecting pipes permits a further simplification in manufacture, and retains the capability to be assembled simply and reliably by means of retaining nuts.

BRIEF DESCRIPTION OF THE DRAWINGS

The invention is explained in more detail with the aid of the illustrative embodiment shown in the attached drawings in which.

DETAILED DESCRIPTION OF THE PRESENTLY PREFERRED EMBODIMENT

The evaporator block shown in the figures consists of a plastic connecting box 1 which is sealed to, and firmly bonded to a bundle of metallic evaporator pipes 3 held together by aluminum cooling fin 2. The ends of the pipes 3 are embedded in a curable plastic 4 which secures the pipes 3 to the connecting box 1.

Figure 1:
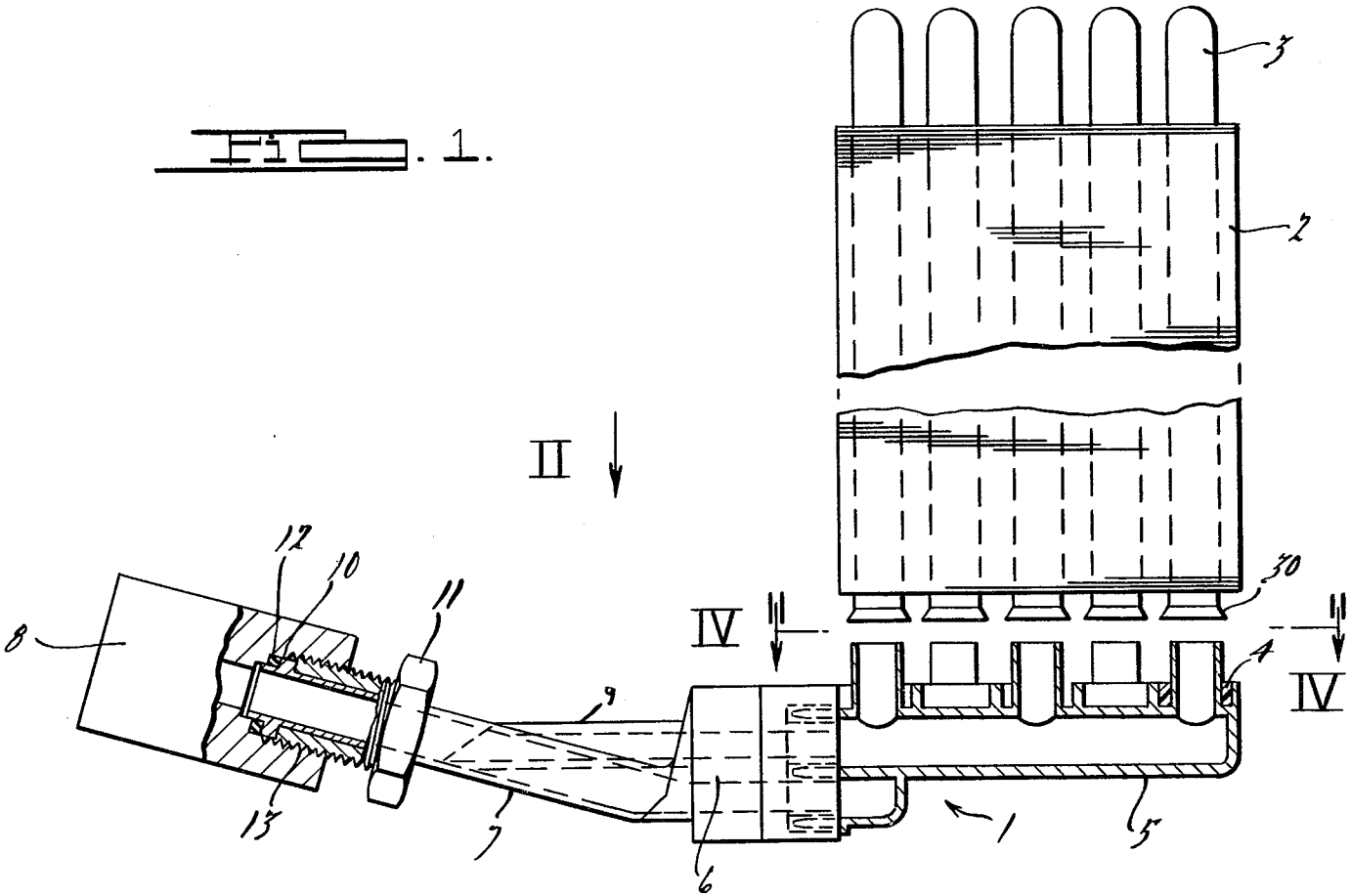
FIG. 1 shows a view of the evaporator block with the connecting box not yet fitted and shown partially in section.
Figure 2:
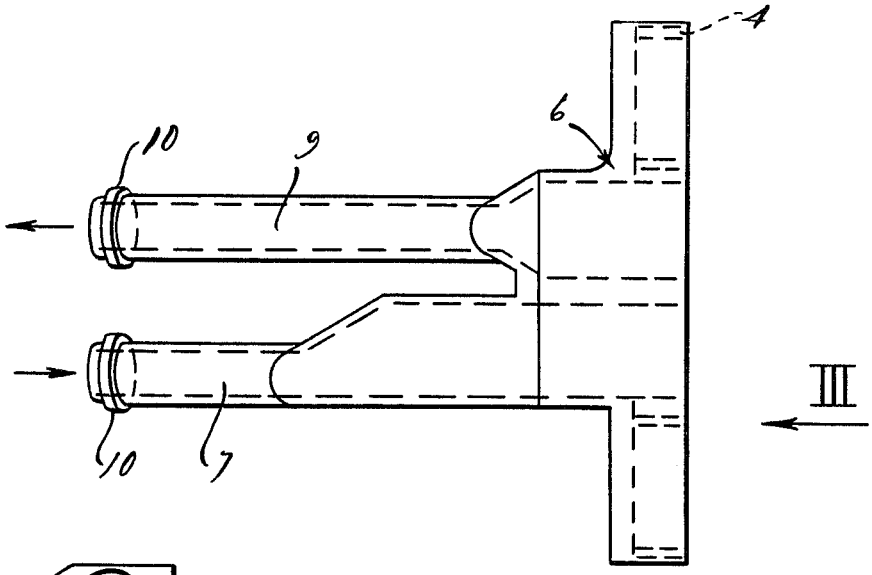
FIG. 2 shows a view of the connecting part in the direction of the arrow II in FIG. 1.

The connecting box 1 includes a distributor part 5 and a connecting part 6. FIG. 2 shows the connecting pipe 7 for the injection valve 8 and a connecting pipe 9 for the compressor intake line (not shown). Both connecting pipes, 7 and 9, are provided at their ends with integrally molded-on collars 10. Pipe 7 can be coupled to injection valve 8 by retaining nut 11 with interposition of a sealing ring 12 in a threaded bore 13 in the injection valve 8. Pipe 9 can likewise be coupled to the compressor intake line.

Figure 3:
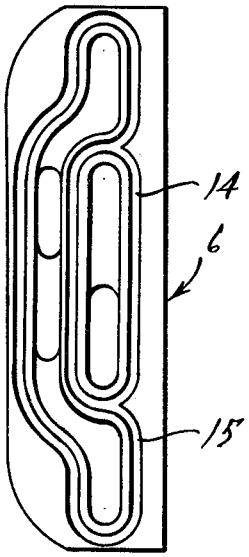
FIG. 3 shows a view of the connecting part in the direction of the arrow III in FIG. 2.

As may be seen from FIG. 3, the connecting side of the connecting part 6 is provided with grooves 14 and 15 which run into one another and form endless loops.

Figure 4:
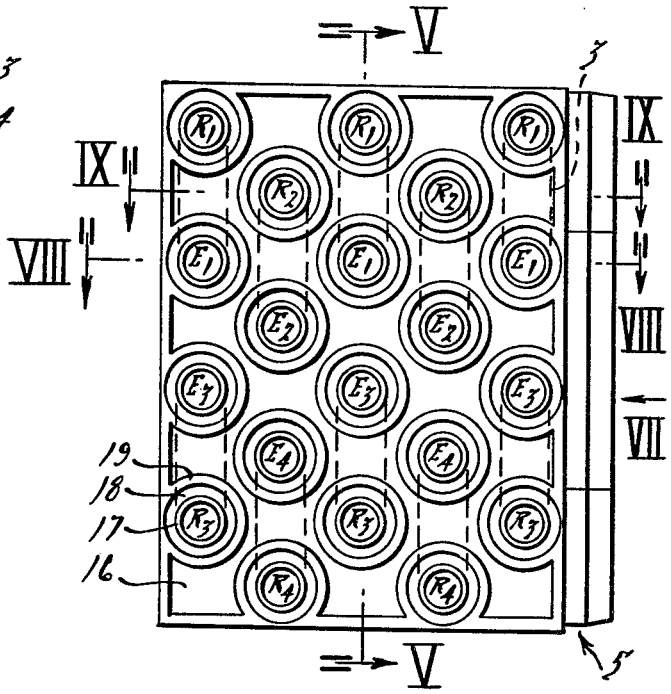
FIG. 4 shows a view of the distributor part in the direction of the line IV—IV in FIG. 1.
Figure 6:
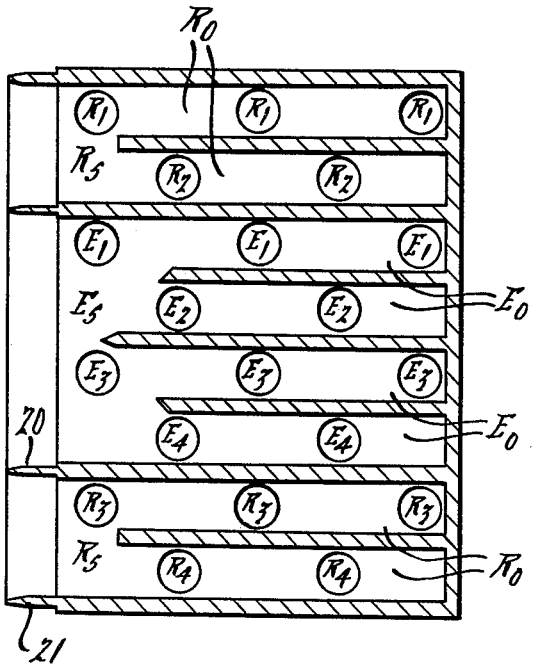
FIG. 6 shows a cross-section along line VI—VI in FIG. 5.

FIG. 4 shows the distributor part 5. It has a side 16, from which projects a plurality of pipe nozzles 17, which are surrounded by annular shoulders 19 which form axially open annular grooves 18 therebetween.

The pipe nozzles 17 form a plurality of injection orifices marked E and a plurality of return flow orifices marked R. Each pipe nozzle of an injection orifice E is bonded to the inlet end of a U-shaped evaporator pipe 3, indicated in broken lines in FIG. 4, the outlet end of which is bonded to the adjacent pipe nozzle of the return flow orifice R.

A plurality of injection orifices E, and a plurality of return flow orifices R, are respectively brought together appropriately via parallel tubular injection chambers and return flow chambers, Eo and Ro respectively, on the connecting side of the distributor part 5, and via two collecting chambers Es and Rs respectively.

Figure 7:
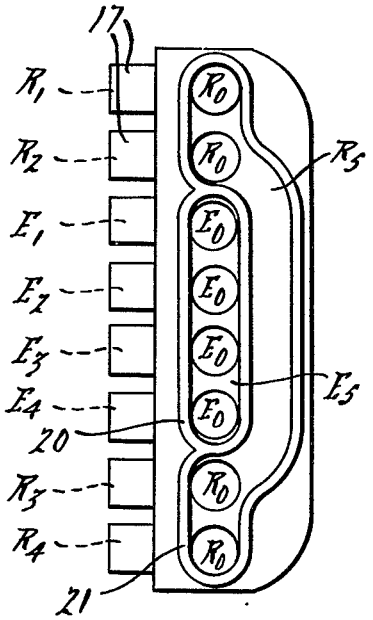
FIG. 7 shows a view in the direction of the arrow VII in FIG. 4.

As can be seen from FIG. 7, the collecting chambers Es and Rs are surrounded by tongues 20 and 21 which merge into one another and form endless loops.

As shown in FIG. 3 and FIG. 7, the path of the grooves 14 and 15 on the connecting side of the connecting part 6 align with the path of the tongues 20 and 21 on the connecting side of the distributor part 5. By introducing a curable plastic into the grooves 14 and 15, inserting the tongues 20 and 21 into the grooves filled with plastic and then curing the plastic, the distributor part 6 is sealed to, and firmly bonded to, the connecting part 6 of the connecting box 1.

Thereafter, the axially open annular grooves 18 present at the side 16 of the distributor part 5 can be filled with a curable plastic 4, after which the pipe ends of the pipe bundle consisting of a plurality of metallic evaporator pipes 3 can be sealed to, and firmly bonded to, the connecting box 1, by inserting them into the annular grooves filled with curable plastic and then curing the plastic.

Reference is made to German Patent Application No. P 27 28 827.3-13 and corresponding U.S. patent application Ser. No. 919,584 for teaching the specific construction of the pipe nozzles projecting from the side 16 of the distributor part 5 in conjunction with the annular grooves 18 which receive the curable plastic 4, the annular shoulder 19 surrounding the annular grooves 18 and the pipe collar 30 of the metallic evaporator pipes 3 which can be pushed onto the pipe nozzles 17 and inserted into the annular grooves. This specific method of securing the evaporator pipes to the distributor part ensures appropriately high strength of the bond between the connecting box 1 made of plastic and the evaporator pipes 3 made of metal.

Figure 8:
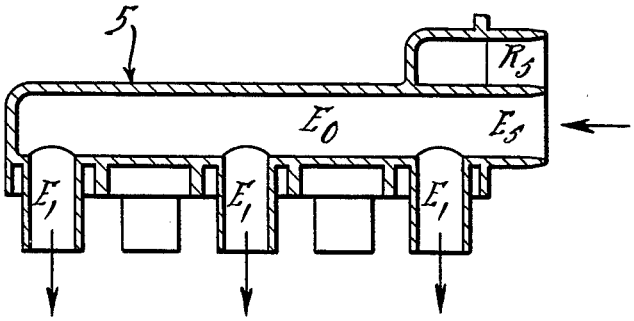
FIG. 8 shows a cross-section along line VIII—VIII in FIG. 4.
Figure 9:
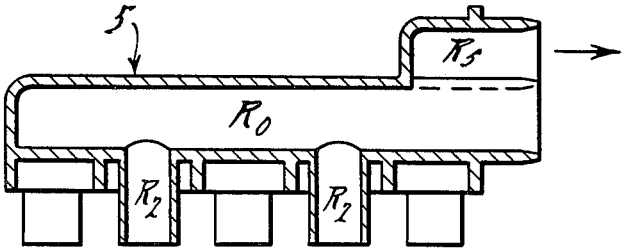
FIG. 9 shows a cross-section along line IX—IX in FIG. 4.
Figure 5:
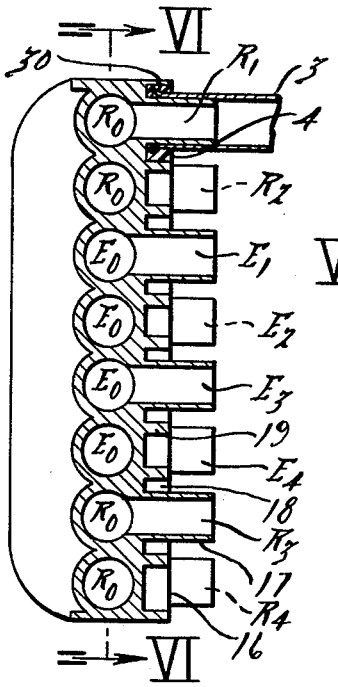
FIG. 5 shows a cross section along line V—V in FIG. 4.

The cross-sections, shown in FIGS. 8 and 9, through the distributor part 5 of the connecting box 1 reveals the transistion of the tubular injection chambers and return flow chambers Eo and Ro to the corresponding collecting chambers E and R.

The two-part construction of the connecting box 1 permits simple manufacture of the various individual components, the distributor part 5 and the connecting part 6, and allows these two components to be bonded together practically while producing the bond between the connecting box 1 and the pipe bundle of evaporator pipes 3.

The introduction of the curable plastic into the grooves 14 and 15 of the connecting part 6 can take place approximately simultaneously with the introduction of the plastic into the annular grooves 18 on the distributor part 5. Thereafter it is possible to bring together the two parts of the connecting box 1, and also to bring the evaporator pipes 3 together with the connecting box 1, and to finish the entire evaporator block in a single curing operation.

The depth of the grooves 14 and 15 in conjunction with the height of the tongues 20 and 21, and the flange-like construction of the connecting sides of the two components of the connecting box 1, ensure that the curable plastic cannot drain away in an undesired manner prior to the curing process. The tongue and groove bond of the two components of the connecting box 1 ensures a very strong bond which fully withstands the conditions to which an evaporator is exposed during operation.

Variations and modifications of the present invention are possible without departing from its scope and spirit which is defined by the appended claims.

We claim:

1. An evaporator, for air conditioning installations comprising:

a plastic connecting box divided into a forward flow chamber and a return flow chamber;

a pipe bundle of U-shaped metal pipes held together by cooling fins sealed and firmly bonded to the connecting box; the seal and bond being effected by a curable plastic in which the pipe ends are embedded;

said connecting box includes:

a distributor part which possesses several tubular injection chambers and return flow chambers located parallel to one another, each of which groups together a plurality of injection orifices or a plurality of return flow orifices respectively and also includes an injection collecting chamber and a return flow collecting chamber which correspondingly merge the respective injecting chambers and return flow chambers together, and a connecting part which is secured to the distributor part and forms connecting pipes connectable to an injection valve and compressor intake line respectively, the respective connecting pipes also being in fluid communication with the injection collecting chamber and return flow collecting chamber respectively, said connecting part being firmly bonded to the distributor part via a tongue and groove bond by means of a curable plastic.

2. An evaporator according to claim 1, wherein the connecting pipes for the injection valve and the compressor intake line are provided with integrally molded-on collars, said molded-on collars and connecting pipes constructed to be fixed with interposition of a sealing ring in threaded bores in said injection valve and compressor intake line by means of retaining nuts.

* * * * *